US010656579B1

(12) United States Patent
Shimohora et al.

(10) Patent No.: US 10,656,579 B1
(45) Date of Patent: May 19, 2020

(54) FIXING DEVICE AND IMAGE FORMING APPARATUS

(71) Applicant: KYOCERA Document Solutions Inc., Osaka (JP)

(72) Inventors: Yuya Shimohora, Osaka (JP); Tetsuro Kawashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/677,049

(22) Filed: Nov. 7, 2019

(30) Foreign Application Priority Data

Nov. 9, 2018 (JP) ..... 2018-211232

(51) Int. Cl.
*G03G 15/20* (2006.01)

(52) U.S. Cl.
CPC ..... *G03G 15/2053* (2013.01); *G03G 15/2025* (2013.01); *G03G 15/2064* (2013.01)

(58) Field of Classification Search
CPC ..... G03G 15/2025; G03G 15/2053; G03G 15/2064
See application file for complete search history.

(56) References Cited

U.S. PATENT DOCUMENTS 9,471,018 B2 * 10/2016 Kawaguchi ..... G03G 15/2053
2014/0123796 A1 * 5/2014 Ishida ..... F16H 1/28 74/421 A
2015/0117918 A1 * 4/2015 Suzuki ..... G03G 15/2053 399/320
2015/0369338 A1 * 12/2015 Sugita ..... F16H 1/10 399/167
2016/0132003 A1 * 5/2016 Koda ..... G03G 15/2053 399/329

FOREIGN PATENT DOCUMENTS

JP 2002148985 A 5/2002

* cited by examiner

*Primary Examiner* — Ryan D Walsh
(74) *Attorney, Agent, or Firm* — Studebaker & Brackett PC

(57) ABSTRACT

A fixing device includes a heating belt, a pressing roller, a pressing member and a cap. The pressing member faces an inner circumferential face of the heating belt via a lubricant. The cap is rotating together with the heating belt. The cap has a disk part, a cylindrical part, a gear and a hole part. The cylindrical part has an inner circumferential face coming into contact with the outer circumferential face of the heating belt. The gear is formed integrally with an outer face of the disk part. The hole part penetrates from the inner circumferential face of the cylindrical part to a face between adjacently disposed teeth of the gear. The lubricant flowed from the inner circumferential face of the heating belt to the outer circumferential face of the heating belt flows to a tooth surface of the gear through the hole part.

7 Claims, 10 Drawing Sheets

FIXING DEVICE AND IMAGE FORMING APPARATUS

INCORPORATION BY REFERENCE

This application is based on and claims the benefit of priority from Japanese patent application No. 2018-211232 filed on Nov. 9, 2018, which is incorporated by reference in its entirety.

BACKGROUND

The present disclosure relates to a fixing device which fixes a toner on a sheet and an image forming apparatus including the fixing device.

As an example of the fixing device which fixes a toner on a sheet, a sliding belt type fixing device is known. The fixing device of the type includes a pressing roller, a cylindrical heating belt, a nip plate facing the inner circumferential face of the heating belt via a lubricant and holding the heating belt with the pressing roller and a heating part which heats the heating belt. The pressing roller is pressed against the nip plate via the heating belt, and then a pressing area is formed between the pressing roller and the heating belt. When the pressing roller is driven to be rotated, the heating belt is driven by the pressure roller to be rotated. The sheet on which the toner is transferred is held and conveyed by the heating belt and the pressing roller at the pressing area. Then, the toner is pressed at the pressing area and heated by the heating part to be fixed on the sheet.

In the above fixing device, as an abrasion and a deterioration of the heating belt, the pressing roller and the nip plate proceed, a slip may occur between the heating belt and the pressing roller. If a rotation speed of the heating belt is decreased owing to the slip, the heating belt may be abnormally heated locally and then deformed. In order to prevent the abnormality, a technique is known, in which a rotation speed of the hating belt is detected by using a cap attached to the end of the heating belt and a heating value of the heating means is controlled depending on the detected rotation speed. The cap has a disk part facing the end face of the heating belt and a cylindrical part having the inner circumferential face coming into contact with the outer circumferential face of the heating belt, and is rotated together with the heating belt.

However, in a case where a large amount of lubricant is applied in order to reduce a friction resistance between the heating belt and the nip plate for a long period, the lubricant leaks from the end of the heating belt to the inner circumferential face of the cap, and a slip occurs between the heating belt and the cap. On the other hand, if an amount of the lubricant is decreased, the lubricant is exhausted at an early stage, a frictional resistance between the heating belt and the nip plate is increased, and then a slip may occur between the heating belt and the pressing roller.

Then, conventionally, a technique to inhibit the leakage of the lubricant from the heating belt is discussed. For example, an end attachment member may be provided, which has a belt end guide face to guide the inner circumferential face of the end of the heating belt. On the belt end guide face, a plurality of grooves is formed along the rotational direction of the heating belt.

However, because of a flexibility of the heating belt, a contact between the heating belt and the end attachment member is unstable, and an effect to inhibit the leakage of the lubricant is insufficient. In order to compensate the insufficiency, if the end attachment member is forcefully made to come into contact with the heating belt, the heating belt is applied with excessive stress. Then, in addition to increased risk of break of the heating belt, an abrasion of the inner circumferential face of the heating belt may occur by increase in contact pressure. Although a mechanism to detect a rotational speed of the heating belt is lubricated with a grease, because a conventional grease has a relatively high viscosity, a load is increased by viscose resistance. Additionally, because a work for applying the grease is required, there is a problem in productivity.

SUMMARY

In accordance with an aspect of the present disclosure, a fixing device includes a heating belt, a pressing roller, a pressing member and a cap. The heating belt is rotatable and cylindrical. The pressing roller comes into contact with an outer circumferential face of the heating belt. The pressing member faces an inner circumferential face of the heating belt via a lubricant. The heating belt is held between the pressing roller and the pressing member. The cap is rotating together with the heating belt. The cap has a disk part, a cylindrical part, a gear and a hole part. The disk part faces an end face of the heating belt. The cylindrical part is formed integrally with the disk part and has an inner circumferential face coming into contact with the outer circumferential face of the heating belt. The gear is formed integrally with an outer face of the disk part. The hole part penetrates from the inner circumferential face of the cylindrical part to a face between adjacently disposed teeth of the gear. The lubricant flowed from the inner circumferential face of the heating belt to the outer circumferential face of the heating belt flows to a tooth surface of the gear through the hole part.

In accordance with an aspect of the present disclosure, an image forming apparatus includes an image forming part which forms a toner image on sheet; and the fixing device which fixes the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a printer 1 (an example an image forming apparatus) and a fixing device 9 will be described with reference to the drawings.

Figure 1:
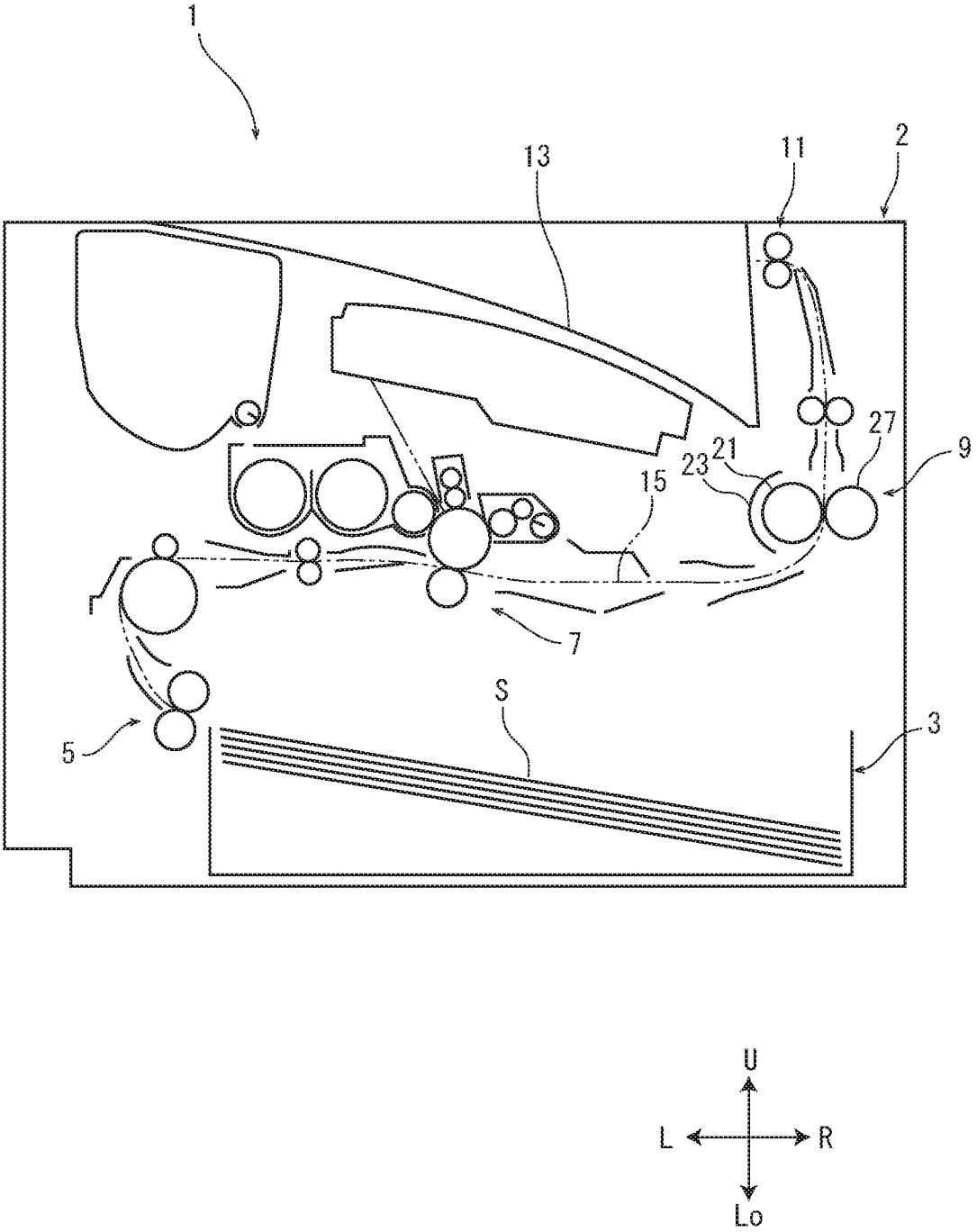
FIG. 1 is a front view schematically showing an inner structure of a printer according to one embodiment of the present disclosure.

Firstly, with reference to FIG. 1, an entire structure of the printer 1 will be described. FIG. 1 is a front view schematically showing an inner structure of the printer 1. In the following description, a front side on a paper surface in FIG. 1 is defined as a front side of the printer 1, and the left-and-right direction is based on a direction where the printer 1 is viewed from the front side. In each figure, U, Lo, L, R, Fr and Rr respectively show an upper, a lower, a left, a right, a front and a rear.

An apparatus main body 2 of the printer 1 is provided with a sheet feeding cassette 3 in which a sheet S is stored, a sheet feeding device 5 which feeds the sheet S from the sheet feeding cassette 3, an image forming part 7 which forms a toner image to the sheet S, a fixing device 9 which fixes the toner image on the sheet S, a discharge device 11 which discharges the sheet S and a discharge tray 13 on which the sheet S is stacked. In the apparatus main body 2, a conveyance path 15 for the sheet S is formed from the sheet feeding device 5 through the image forming part 7 and the fixing device 9 to the discharge device 11.

The sheet S fed by the sheet feeding device 5 from the sheet feeding cassette 3 is conveyed along the conveyance path 15 to the image forming part 7. The image forming part 7 forms a toner image on the sheet S. The sheet S is conveyed along the conveyance path 15 to the fixing device 9. The fixing device 9 fixes the toner image on the sheet S. The sheet S on which the toner image is fixed is discharged by the discharge device 11 and then stacked on the discharge tray 13.

Figure 2:
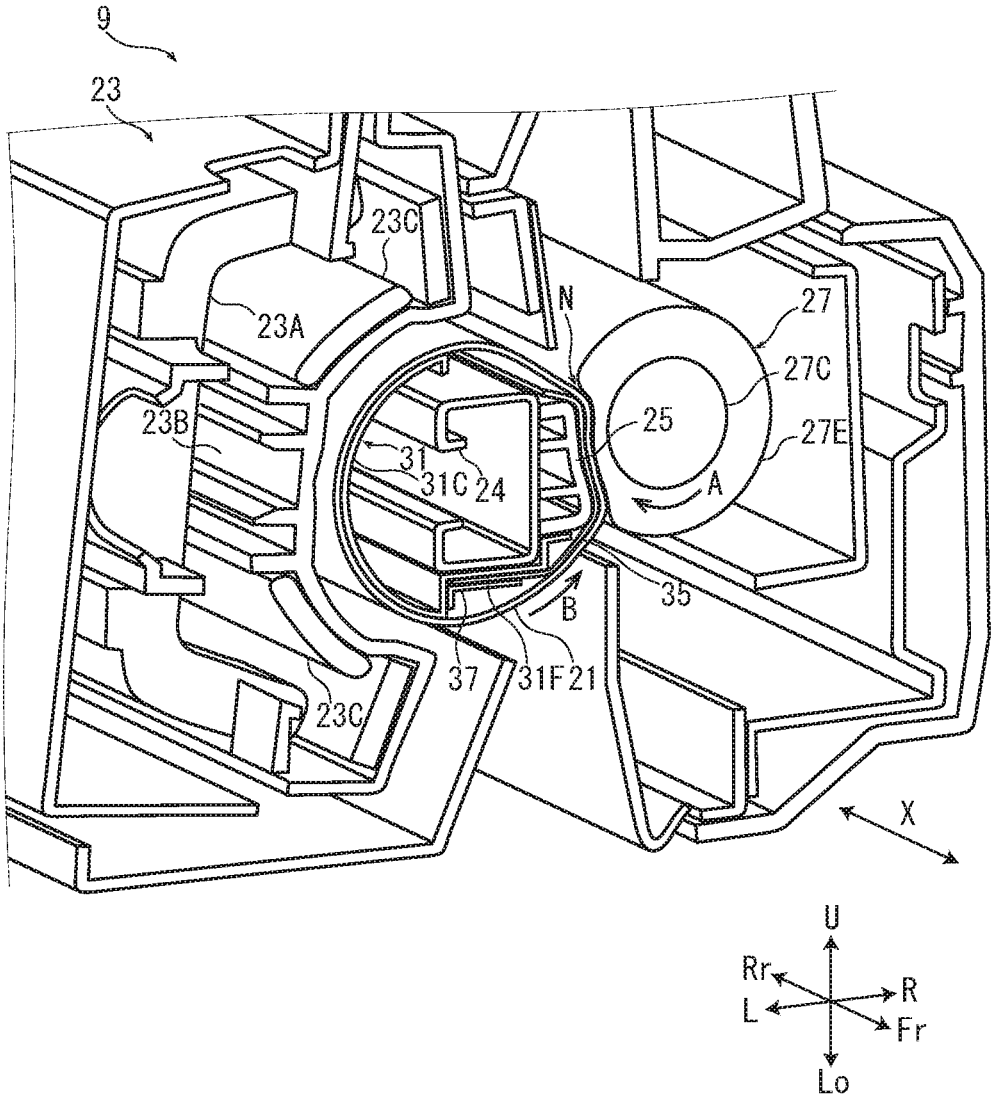
FIG. 2 is a perspective view showing a cross section of a fixing device according to the embodiment of the present disclosure.
Figure 3:
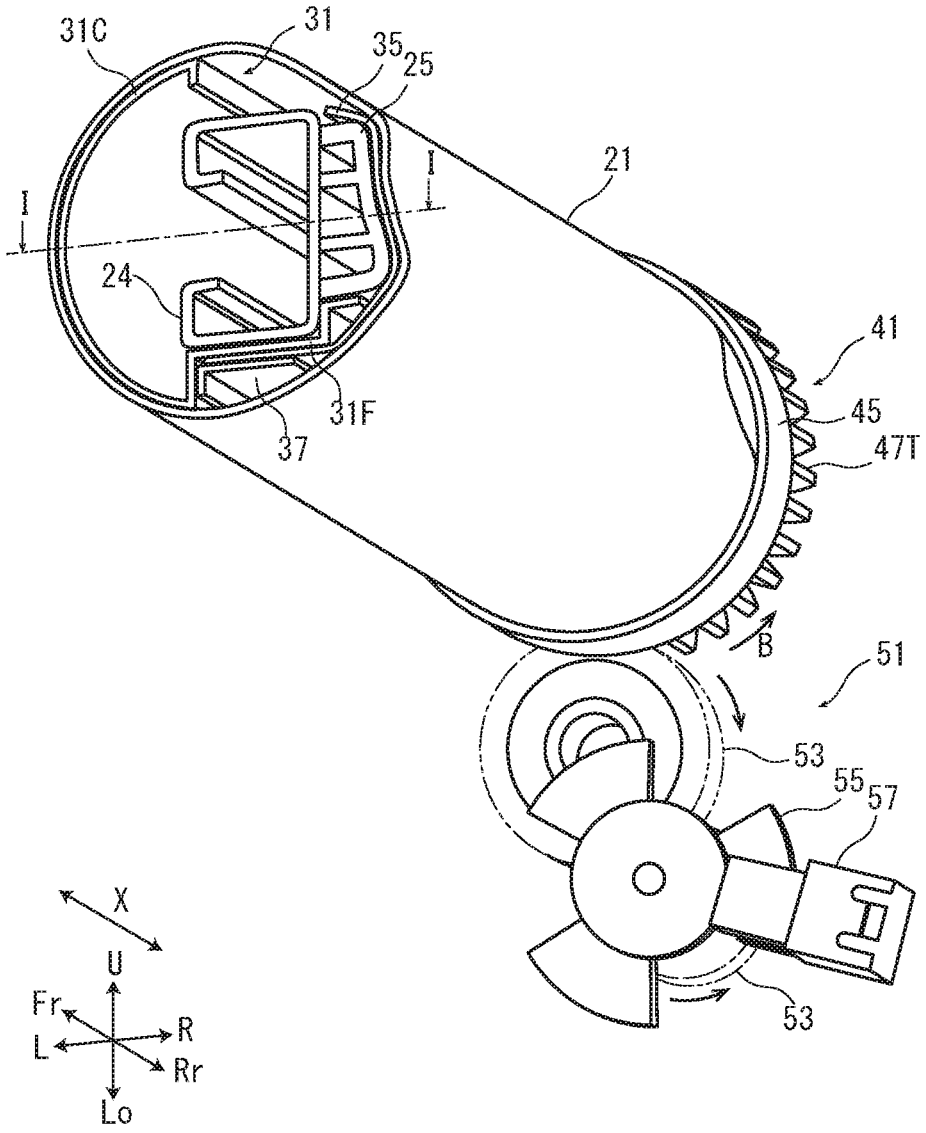
FIG. 3 is a perspective view showing a rotation detection mechanism of the fixing device according to the embodiment of the present disclosure.
Figure 4:
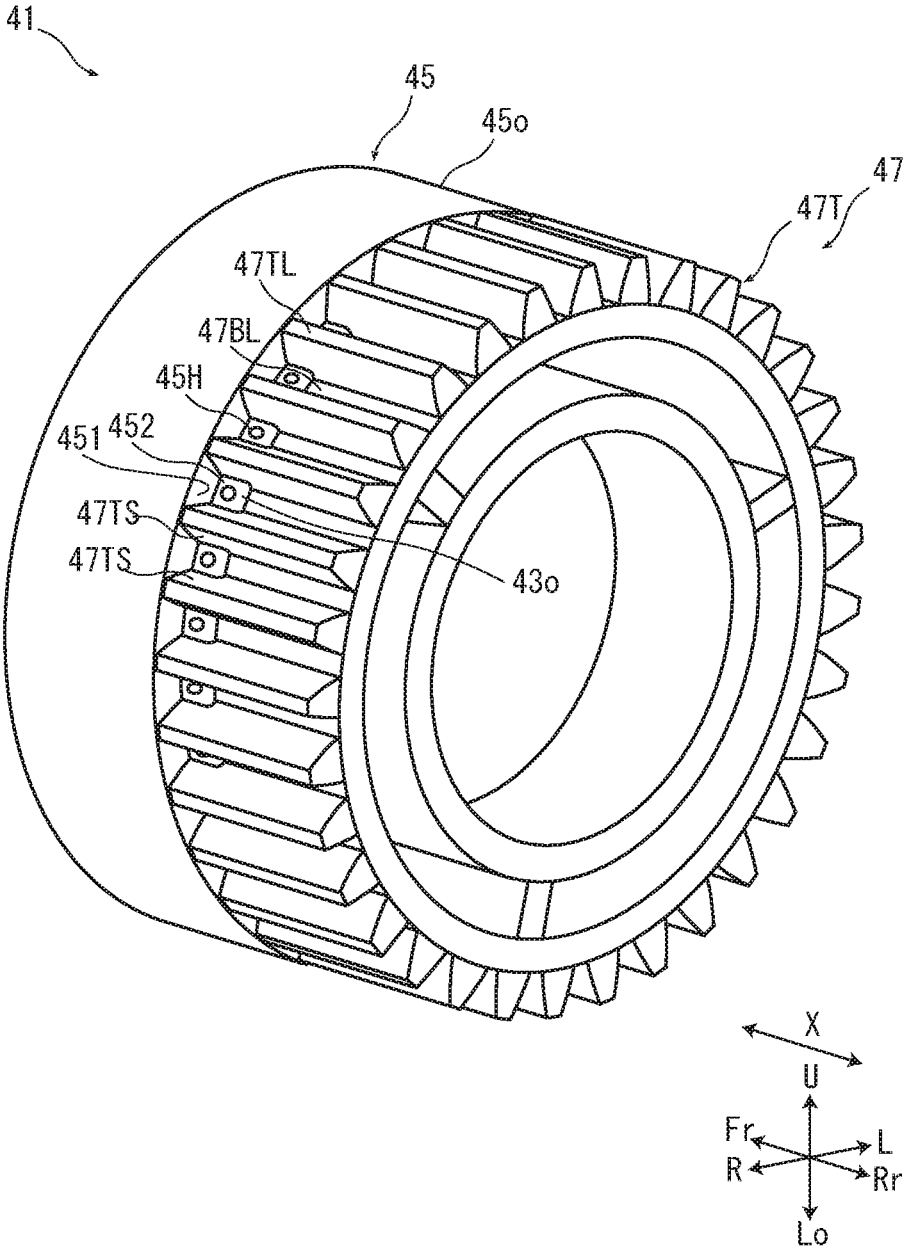
FIG. 4 is a perspective view showing a cap of the fixing device according to the embodiment of the present disclosure.
Figure 5:
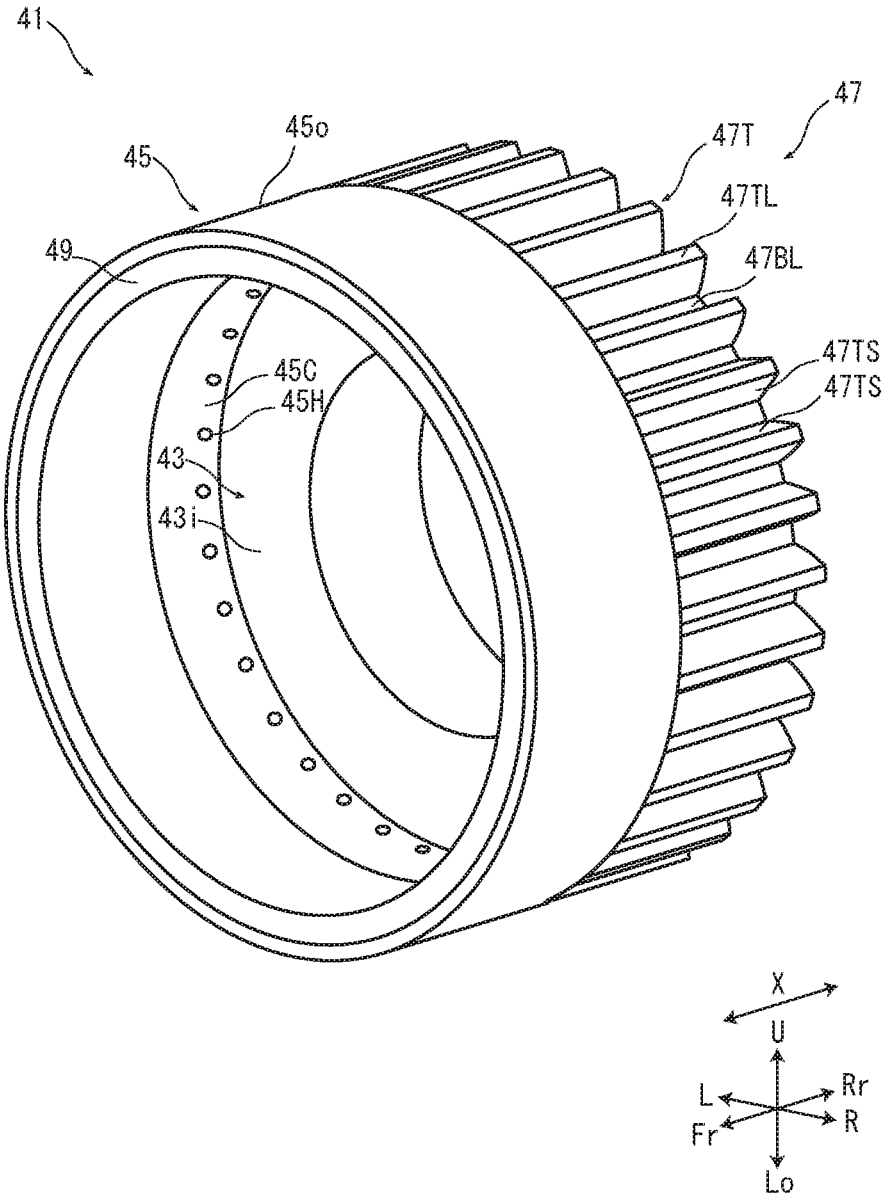
FIG. 5 is a perspective view showing the cap of the fixing device according to the embodiment of the present disclosure.
Figure 6:
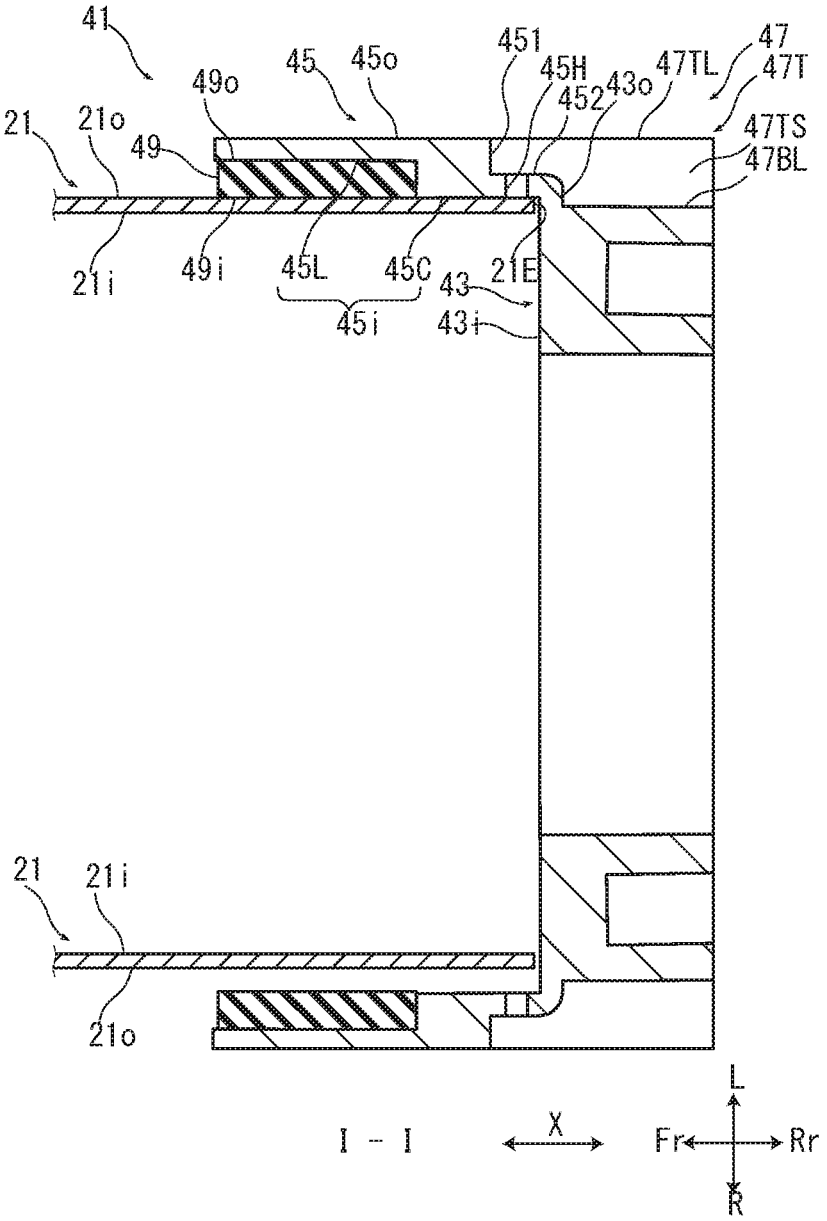
FIG. 6 is a cross sectional view along a I-I line in FIG. 3.

Next, with reference to FIG. 2 to FIG. 6, the fixing device 9 according to one embodiment of the present disclosure will be described. FIG. 2 is a perspective view showing a cross section of the fixing device 9. FIG. 3 is a perspective view showing a rotation detection mechanism 51. FIG. 4 and FIG. 5 are perspective views showing a cap 41. FIG. 6 is a cross sectional view along a I-I line in FIG. 3.

The fixing device 9 includes a cylindrical rotatable heating belt 21, a pressing roller 27, a nip plate 25 (an example of a pressing member), a sliding sheet 35, a metal plate 31, a fixing member 24, an IH heater 23 (an example of a heating part), a cap 41 and a rotation detection mechanism 51. The pressing roller 27 comes into contact with the outer circumferential face 210 of the heating belt 21. The nip plate 25 faces the inner circumferential face 21*i* of the heating belt 21 via a lubricant. The heating belt 21 is held between the nip plate 25 and the pressing roller 27. The sliding sheet 35 is impregnated with the lubricant and covers the nip plate 25. The metal plate 31 comes into contact with the inner circumferential face 21*i* of the heating belt 21 and supports the heating belt 21. The nip plate 25 and the metal plate 31 is fixed to the fixing member 24. The IH heater 23 heats the heating belt 21. The cap 41 is formed integrally with a gear 47 and disposed at the rear end of the heating belt 21. The rotation detection mechanism 51 detects a rotation transmitted from the gear 47.

In the following description, an axial direction X shows the axial direction of the pressing roller 27 (the front-and-rear direction, the longitudinal direction). Hereinafter, an example where the fixing device 9 is disposed in a posture where the heating belt 21 is positioned on the left side of the pressing roller 27; however, the fixing device 9 may be disposed in any posture.

The fixing belt 21 is a cylindrical endless belt whose longitudinal direction is along the axial direction X, has a predetermined inner diameter and is made of flexible material. The heating belt 21 has a base layer, an elastic layer formed around the outer circumferential face of the base layer and a release layer formed around the outer circumferential face of the elastic layer (they are not shown). The base layer is made of polyimide resin mixed with magnetic metal alloy, such as Ni, or metal powder, such as Cu, Ag and Al. The elastic layer is made of silicon rubber, for example. The release layer is made of PFA tube, for example. The heating belt 21 is disposed such that the outer circumferential face comes into contact with the outer circumferential face of the pressing roller 27.

The pressing roller 27 has a core metal 27C, an elastic layer 27E formed around the outer circumferential face of the core metal 27C and a release layer (not shown) formed around the outer circumferential face of the elastic layer 27E. The core metal 27C is made of metal, such as stainless steel or aluminum alloy. The elastic layer 27E is made of silicon rubber, for example. The release layer is made of PFA tube, for example. The elastic layer 27E has a length in the axial direction X longer than a width in the axial direction X of the sheet S applicable to the printer 1. To the metal core 27C, a drive force is transmitted from a drive source (not shown), such as a motor, via a gear train (not shown). The pressing roller 27 is rotated in a direction A, and the heating belt 21 is driven by the rotation of the pressing roller 27 to be rotated in a direction B.

The nip plate 25 is a member whose longitudinal direction is along in the axial direction X, and made of resin, such as liquid crystal polymer. The nip plate 25 has a length in the axial direction X equal to a length in the axial direction X of the elastic layer 27E of the pressing roller 27. In the cross sectional view in FIG. 2, the right side face of the nip plate 25 is formed in a curved recessed shape. On the left side face of the nip plate 25, a recess extending in the axial direction X is formed.

The nip plate 25 is covered with the sliding sheet 35. The sliding sheet 35 is a sheet member which covers the right side face of the nip plate 25. The sliding sheet 35 is made of fiber woven fabric material having a small frictional resistance, and impregnated with a silicon oil type lubricant. The nip plate 25 is disposed so as to face the inner circumferential face 21*i* of the heating belt 21 via the sliding sheet 35. The heating belt 21 is held between the pressing roller 27 and the nip plate 25.

The metal plate 31 is a member whose longitudinal direction is along the axial direction X, and made of material, such as magnetic stainless steel. The metal plate 31 has a length in the axial direction X equal to a length in the axial direction X of the elastic layer 27E of the pressing roller 27. The metal plate 31 has a curved portion 31C having an arc-shaped cross section along the left side portion of the inner circumferential face 21*i* of the heating belt 21. The curved portion 31C supports the heating belt 21 and provides a tension to the heating belt 21. At the lower end of the curved portion 31C, a fixed portion 31F having a shape corresponding to the lower face of the fixing member 24 is formed.

The nip plate 25 and the metal plate 31 are fixed to the fixing member 24. The fixing member 24 is a member whose longitudinal direction is along the axial direction X, and made of material such as stainless steel. The fixing member 24 has a length in the axial direction X longer than a length in the axial direction X of the hating belt 21. The fixing member 24 penetrates through the inside of the heating belt 21, and its both end portions are fixed to a housing (not shown). On the right side face of the fixing member 24, the left side face of the nip plate 25 is fixed, and on the lower face of the fixing member 24, the fixed portion 31F of the metal plate 31 is fixed. The lower end portion of the sliding sheet 35 is fixed between the lower face of the fixed portion 31F of the metal plate 31 and a fixing element 37.

The IH heater 23 has a coil part 23C, a coil bobbin 23B holding the coil part 23C and an arch core 23A. The IH heater 23 is disposed so as to cover the left side portion of the outer circumferential face 210 of the heating belt 21 via a predetermined gap, and supported by the housing. By applying an AC voltage on the coil part 23*c*, a magnetic field is generated. The magnetic field produces eddy current in the base layer of the heating belt 21 to heat the base layer. Then, the heating belt 21 is heated. The metal plate 31 is heated by the magnetic field generated by the coil part 23C and assists the heating of the heating belt 21.

The cap 41 has a disk part 43, a cylindrical part 45, a gear 47 and a hole part 45H. The disk part 43 faces the end face 21E of the heating belt 21. The cylindrical part 45 is formed integrally with the disk part 43. The inner circumferential face 45*i* of the cylindrical part 45 comes into contact with the outer circumferential face 210 of the heating belt 21. The gear 47 is formed integrally with the outer circumferential face 43*o* of the disk part 43. The hole part 45H penetrates from the inner circumferential face 45*i* of the cylindrical portion 4 to the face between the adjacently disposed teeth 47T of the gear 47. The cap 41 is made of fluorocarbon resin, for example. The cap 41 is disposed at the rear end portion of the heating belt 21 with the cylindrical part 45 on the front side and the gear 47 on the rear side.

As shown in FIG. 5 and FIG. 6, the inner circumferential face 43*i* of the disk part 43 faces the end face 21E of the heating belt 21. FIG. 6 shows an example where the inner circumferential face 43*i* of the disk part 43 separates from the end face 21E of the heating belt 21; however, the inner circumferential face 43*i* of the disk part 43 may come into contact with the end face 21E of the heating belt 21.

The inner circumferential face 45*i* of the cylindrical part 45 has a contact portion 45C coming into contact with the outer circumferential face 210 of the heating belt 21 and a large diameter portion 45L formed closer to a center side than the contact portion 45C in the axial direction X and having an inner diameter larger than an inner diameter of the contact portion 45C. The large diameter portion 45L is provided with an elastic member 49 coming into contact with the outer circumferential face 210 of the heating belt 21. The elastic member 49 is an annular member having a rectangular cross section, and made of rubber or the like. The outer circumferential face 490 of the elastic member 49 is adhered on the large diameter portion 45L of the inner circumferential face 45*i* of the cylindrical part 45. The contact portion 45C of the inner circumferential face 45*i* of the cylindrical part 45 and the inner circumferential face 49*i* of the elastic member 49 come into contact with the outer circumferential face 210 of the heating belt 21. By a frictional resistance between the inner circumferential face 49*i* of the elastic member 49 and the outer circumferential face 210 of the heating belt 21, the cap 41 is driven by the heating belt 21 to be rotated.

The gear 47 is a spur gear having the same rotational center as the disk part 43 and the cylindrical part 45. As shown in FIG. 4 and FIG. 6, on the rear portion of the cylindrical part 45, a first face 451 and a second face 452 are formed. The first face 451 is formed on the front side of the outer circumferential face 43*o* of the disk part 43 and parallel to the outer circumferential face 43*o*. The second face 452 is formed on a side closer to a tooth tip 47TL than a tooth bottom 47BL and parallel to the tooth bottom 47BL. The first face 451 and the second face 452 are continued to a tooth surface 47TS. In other words, the first face 451 and the second face 452 are formed between the adjacently disposed teeth 471. The outer circumferential face 450 of the cylindrical part 45 is formed to be larger than an outer diameter of an addendum circle of the gear 47.

As shown in FIG. 5 and FIG. 6, the hole part 45H penetrates through the cylindrical part 45 radially from the contact portion 45C to the second face 452. The hole part 45H is disposed on a front side (a center side in the axial direction X) of the end face 21E of the heating belt 21 in the contact portion 45C. In the example, the hole part 45H has a circular cross section; however, the hole part 45H may have any cross section.

The rotation detection mechanism 51 includes a gear train 53, a light-shielding plate 55 and a photo-interrupter 57. The light-spieling plate 55 is provided on the same axis as an output gear of the gear train 53. A rotation is transmitted from the gear 47 to the light-shieling plate 55 through the gear train 53, and the photo-interrupter 57 outputs a signal indicating a rotation number of the light-shielding plate 55. The output signal is sent to a controller (not shown) of the printer, and the controller controls a heat amount of the IH heater 23 based on the rotation number.

A fixing operation of the fixing device 9 having the above described configuration will be described with reference to FIG. 2. The pressing roller 27 is pressed against the nip plate 25 through the heating belt 21, and the pressing area N is formed between the pressing roller 27 and the heating belt 21. When the pressing roller 27 is driven to be rotated in the rotation direction A, the heating belt 21 is driven by the pressing roller 27 to be rotated in the rotation direction B. The sheet S on which the toner is transferred is held between the pressing roller 27 and the heating belt 21 at the pressing area N, and conveyed upwardly. At this time, the toner is pressed and heated in the pressing area N and then fixed on the sheet S.

The hearting belt 21 is rotated while sliding with respect to the sliding sheet 35 and the metal plate 31. The lubricant impregnated in the sliding sheet 35 reduces a frictional resistance between the sliding sheet 35 and the heating belt 21. Additionally, as the heating belt 21 is rotated, the lubricant oozes from the sliding sheet 35 on the inner circumferential face 21*i* of the heating belt 21, and is carried to the curved portion 31C of the metal plate 31 by the heating belt 21 to reduce a frictional resistance between the heating belt 21 and the metal plate 31.

The lubricant flows from the inner circumferential face 21*i* of the heating belt 21 through the end face 21E to the outer circumferential face 21*o*. The lubricant flowed to the outer circumferential face 210 flows from a side of the contact portion 45C of the inner circumferential face 45*i* of the cap 41 through the hole part 45H to a side of the second face 452 by a centrifugal force generated owing to the rotation of the cap 41, and then flows from the second face 452 to the tooth surface 47TS. The lubricant flowed on the tooth surface 47TS reduces a frictional resistance between the gear 47 and the gear train 53.

According to the above described fixing device 9 according to the present embodiment, the lubricant flowed from the inner circumferential face 21*i* of the heating belt 21 to the outer circumferential face 210 of the heating belt 21 flows through the hole part 45H on the tooth surface 47TS of the gear 47 so that it becomes possible to restrain a slip between the heating belt 21 and the cap 41 owing to the lubricant. Additionally, according to the fixing device 9 of the present embodiment, it is not required to increase a contact pressure of the cap 41 with the heating belt 21 so that it becomes possible to restrain a break and an abrasion of the heating belt 21. According to the fixing device 9 of the present embodiment, the lubricant flowed to the tooth surface 47TS of the gear 47 serves as a lubricant for the gear 47 so that it becomes possible to omit a work to apply the grease to the gear 47. Accordingly, according to the fixing device 9 of the present embodiment, it becomes possible to use the lubricant without inducing a slip, a break and an abrasion of the heating belt 21 and to omit the work to apply the grease on the gear 47.

By the way, because the lubricant flows along the surface of the heating belt 21, even if the hole part 45H is disposed closer to an outer side in the axial direction than the end face 21E of the heating belt 21 in the contact portion 45C, the lubricant flowed from the inner circumferential face 21*i* to the outer circumferential face 210 of the heating belt 21 reaches the elastic member 49 without flowing into the hole part 45H. Then, the cap 41 may slip with respect to the heating belt 21. If the cap 41 slips, it becomes difficult to correctly detect the rotation speed of the hating belt 21 and then to control the heat amount based on the rotation speed. According to the fixing device 9 of the present embodiment, because the hole part 45H is disposed closer to a center side in the axial direction X than the end face 21E of the heating belt 21, compared with a case where the hole part 45H is disposed closet to an outer side in the axial direction X than the end face 21E of the heating belt 21, it becomes possible to decrease an amount of the lubricant flowed between the heating belt 21 and the elastic member 49. As a result, it becomes possible to restrain a slip between the heating belt 21 and the cap 41 owing to the lubricant.

Additionally, according to the fixing device 9 of the present embodiment, the nip plate 25 is covered with the sliding sheet 35 impregnated with the lubricant so that it becomes possible to delay a time when the lubricant is exhausted, compared with a case where the nip plate 25 is not covered with the sliding sheet 35 impregnated with the lubricant.

The above embodiment may be modified as follows.

Figure 7:
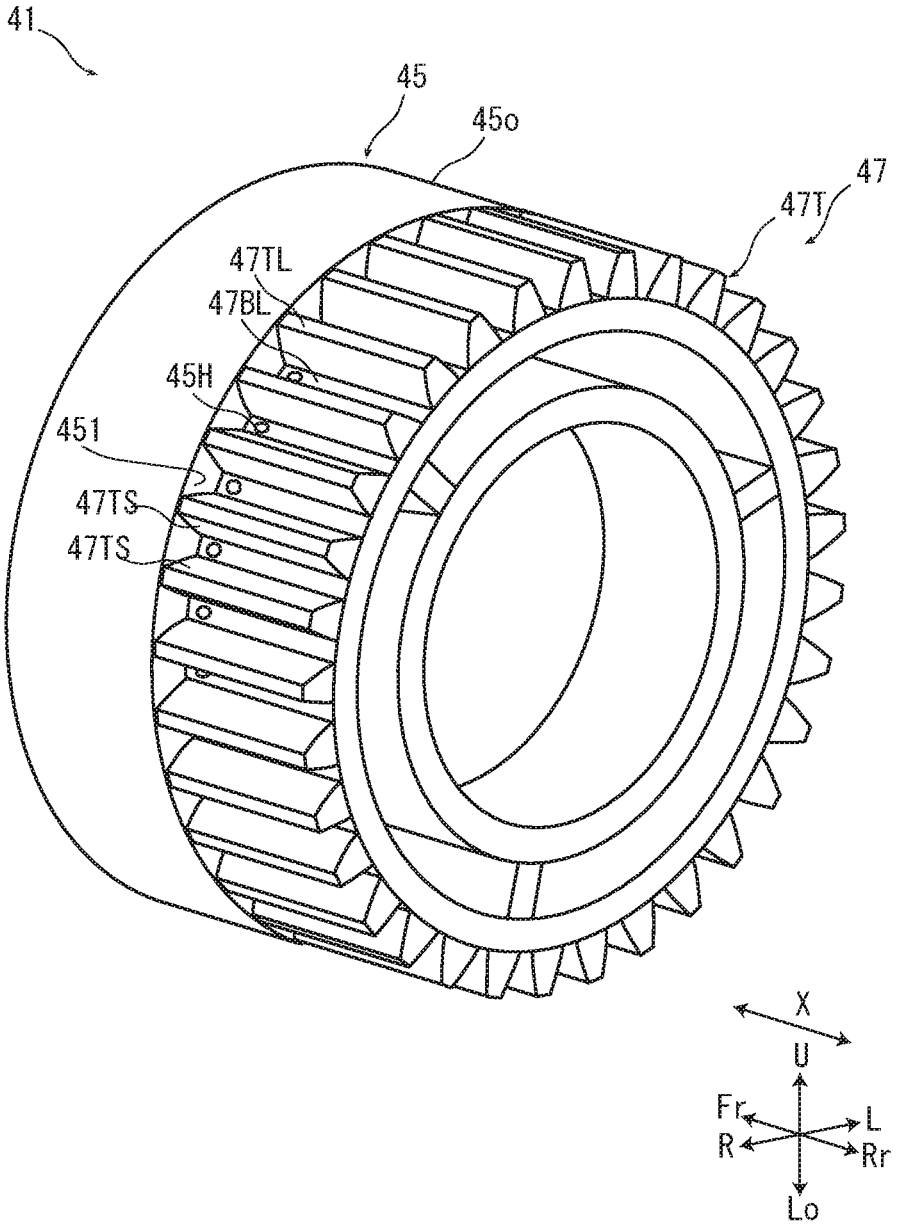
FIG. 7 is a perspective view showing the cap according to a first modified example of the embodiment of the present disclosure.
Figure 8:
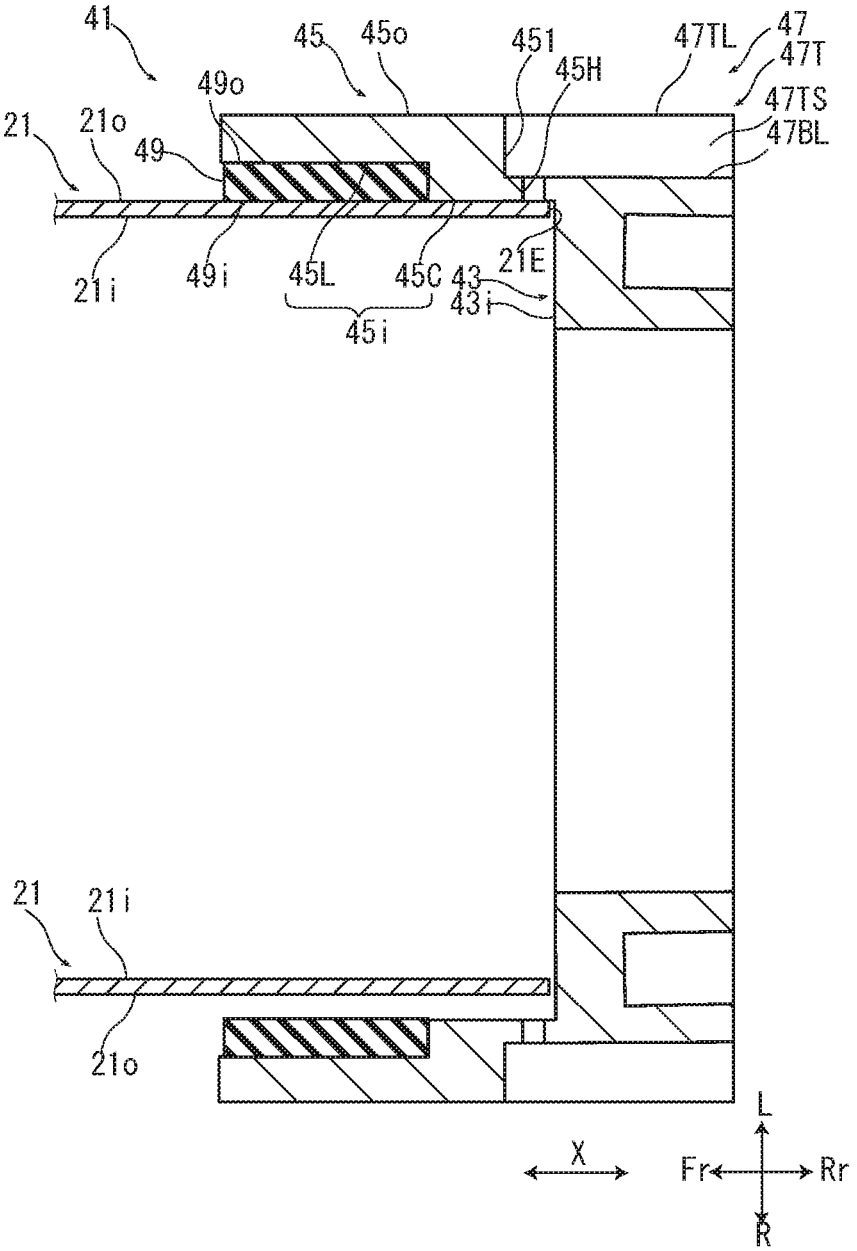
FIG. 8 is a cross sectional view showing the cap according to the first modified example of the embodiment of the present disclosure.

With reference to FIG. 7 and FIG. 8, a first modified example of the above embodiment will be described. FIG. 7 is a perspective view showing the cap 41 of the first modified example. FIG. 8 is a cross sectional view showing the cap 41 of the first modified example. On the rear portion of the cylindrical part 45, the first face 451 is formed, which is disposed on a front side of the inner circumferential face 43*i* of the disk part 43 and parallel to the inner circumferential face 43*i*. Different from the above embodiment, the outer circumferential face 43*o* of the disk part 43 and the second face 452 are not formed, and the tooth bottom 47BL is formed to extend to the first face 451. Obviously, the tooth bottom 47BL is formed between the adjacently disposed teeth 471. The hole part 45H penetrates radially through the cylindrical part 45 form the contact portion 45C to the tooth bottom 47BL. According to the fixing device 9 of the first modified example, the same effect as the above embodiment can be obtained.

Figure 9:
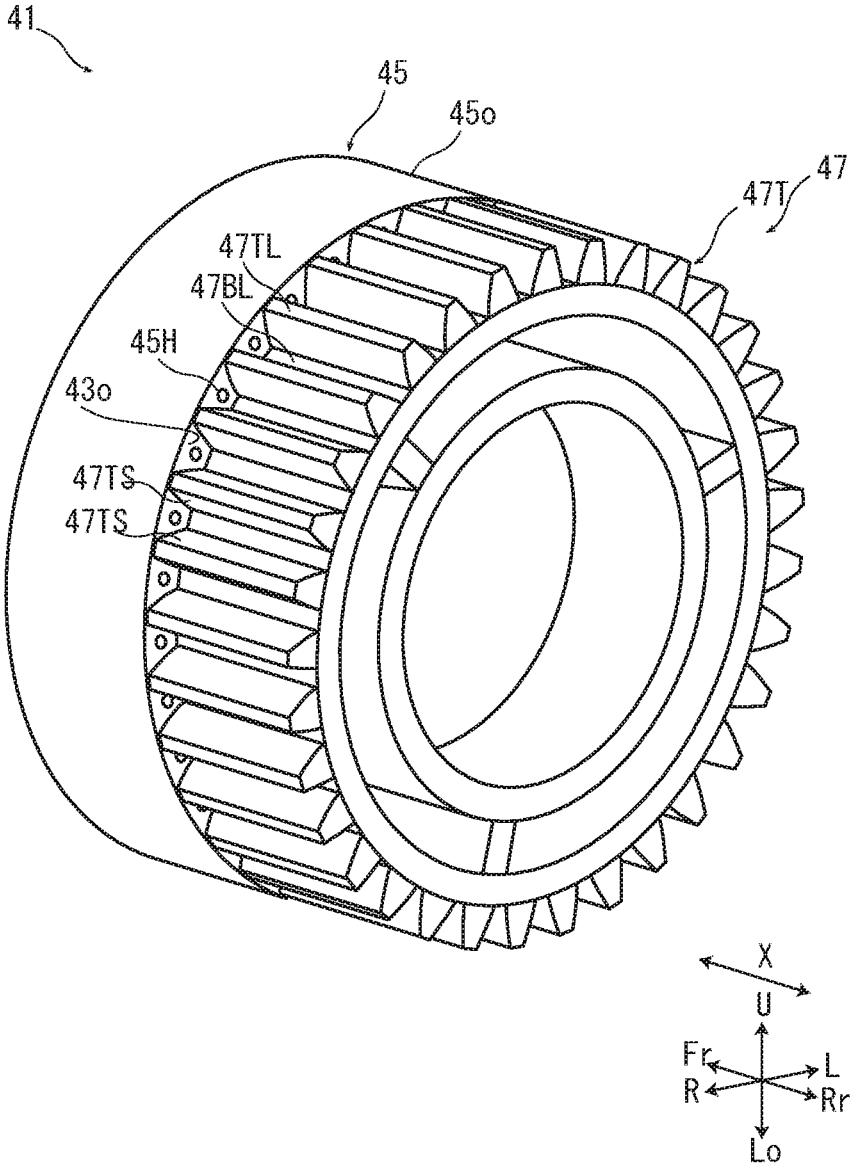
FIG. 9 is a perspective view showing the cap according to a second modified example of the embodiment of the present disclosure.
Figure 10:
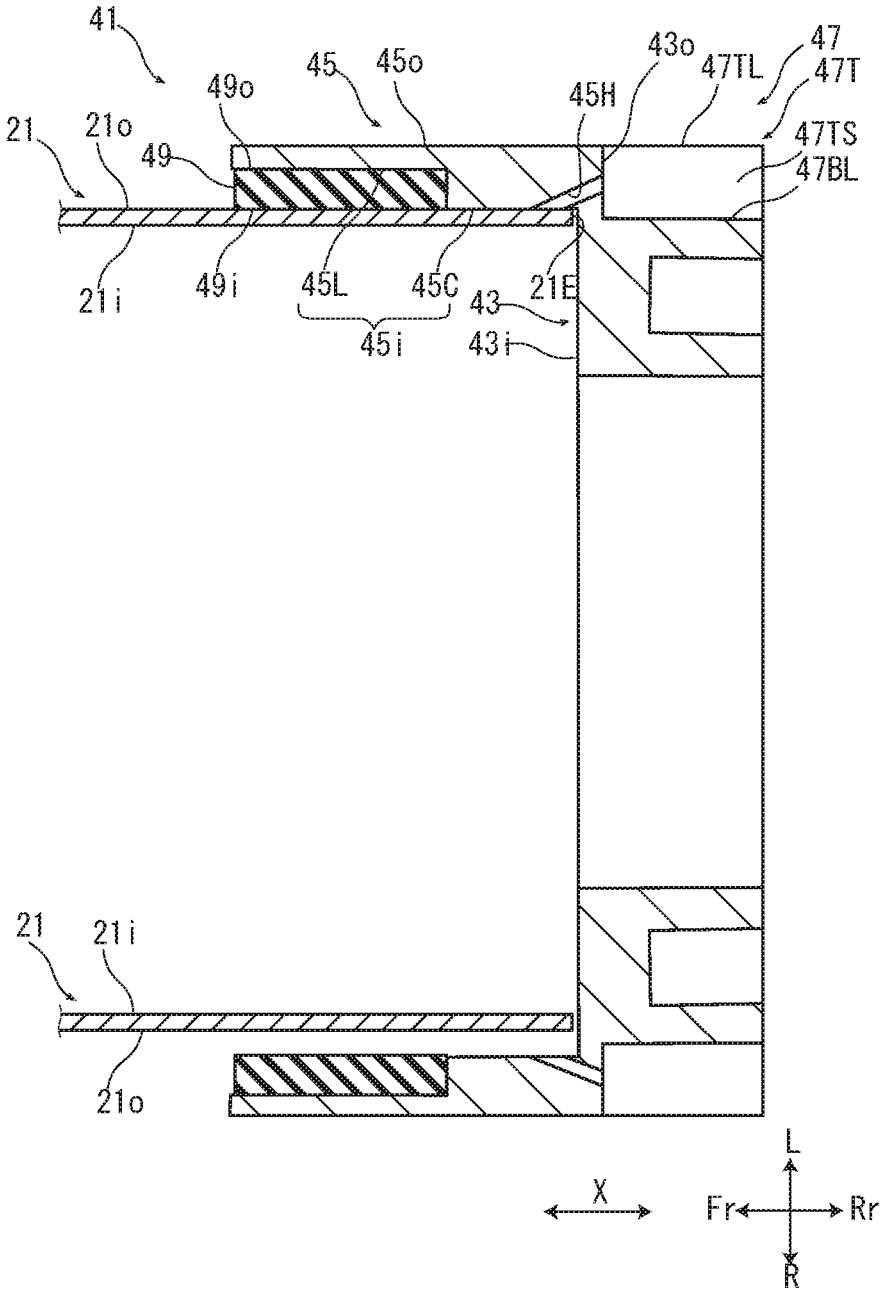
FIG. 10 is a cross sectional view showing the cap according to the second modified example of the embodiment of the present disclosure.

With reference to FIG. 9 and FIG. 10, a second modified example of the above embodiment will be described. FIG. 9 is a perspective view showing the cap 41 of the second modified example. FIG. 10 is a cross sectional view showing the cap 41 of the second modified example. Different from the above embodiment, the first face 451 and the second face 452 are not formed, and the outer circumferential face 43*o* of the disk part 43 is formed to extend to the outer circumferential face 45*o* of the cylindrical part 45. The outer circumferential face 43*o* of the disk part 43 is continued to the tooth surface 47TS. In other words, the outer circumferential face 43*o* is formed between the adjacently disposed teeth 471. The hole part 45H penetrates from the contact portion 45C to the outer circumferential face 43*o* of the disk part 43 through the cylindrical part 45 in a direction inclined in the axis direction X with respect to a radial direction of the cylindrical part 45. According to the fixing device 9 of the second modified example, the same effect as the above embodiment can be obtained.

The present disclosure may be applied to the fixing device 9 which is not provided with the elastic member 49 of the cap 41 (a third modified example). Specifically, the cylindrical part 45 is not provided with the large diameter portion 45L, and the inner circumferential face 45*i* of the cylindrical part 45 comes into contact with the outer circumferential face 210 of the heating belt 21. The hole part 45H is disposed closer to a center side in the axial direction X of the pressing roller 27 than the end face 21E of the heating belt 21 in the inner circumferential face 45*i* of the cylindrical part 45. According to the third modified example, compared with a case where the hole part 45H is disposed closer to an outer side in the axial direction X than the end face 21E of the heating belt 21, it becomes possible to reduce an amount of the lubricant flowed between the heating belt 21 and the cap 41. As a result, it becomes possible to restrain a slip between the heating belt 21 and the cap 41 owing to the lubricant.

The fixing device 9 may not be provided with the sliding sheet 35 shown in the above embodiments. In this case, the lubricant may be applied to the nip plate 25 or the heating belt 21.

The fixing device 9 may not be provided with the fixing member 24 shown in the above embodiments. In this case, the nip plate 25 and the metal plate 31 may be directly fixed to the housing.

In the above embodiment, the IH heater 23 is employed as an example of a heating part; however, a flat heater may be provided as the heating part. In this case, the flat heater may be disposed in place of the nip plate 25, and serve as a function as the pressing member.

Although the present disclosure described the specific embodiment, the present disclosure is not limited to the embodiment. It is to be noted that one skilled in the art can modify the embodiment without departing from the scope and spirit of the present disclosure.

The invention claimed is:

1. A fixing device comprising:

a rotatable cylindrical heating belt;

a pressing roller coming into contact with an outer circumferential face of the heating belt;

a pressing member facing an inner circumferential face of the heating belt via a lubricant, the heating belt being held between the pressing roller and the pressing member; and a cap rotating together with the heating belt, wherein the cap has:

a disk part facing an end face of the heating belt;

a cylindrical part formed integrally with the disk part and having an inner circumferential face coming into contact with the outer circumferential face of the heating belt;

a gear formed integrally with an outer face of the disk part; and a hole part penetrating from the inner circumferential face of the cylindrical part to a face between adjacently disposed teeth of the gear, and the lubricant flowed from the inner circumferential face of the heating belt to the outer circumferential face of the heating belt flows to a tooth surface of the gear through the hole part.

2. The fixing device according to claim 1, wherein the hole part is disposed closer to a center side in an axial direction of the pressing roller than the end face of the heating belt, on the inner circumferential face of the cylindrical part.

3. The fixing device according to claim 1, wherein the inner circumferential face of the cylindrical part has a contact portion coming into contact with the outer circumferential face of the heating belt and a large diameter portion formed closer to a center side in an axial direction of the pressing roller than the contact portion and having an inner diameter larger than an inner diameter of the contact portion, the large diameter portion is provided with an elastic member coming into contact with the outer circumferential face of the heating belt, and the hole part is formed closer to a center side in the axial direction than the end face of the heating belt, on the contact portion.

4. The fixing device according to claim 1, wherein the hole part is opened to a tooth bottom of the gear or the outer face of the disk part.

5. The fixing device according to claim 1, wherein the hole part is formed along a direction containing a component along a radial direction of the cylindrical part.

6. The fixing device according to claim 1, wherein the pressing member is covered with a sliding sheet impregnated with the lubricant.

7. An image forming apparatus comprising:

an image forming part which forms a toner image on sheet; and the fixing device according to claim 1, which fixes the toner image on the sheet.

* * * * *